United States Patent [19]

Kelsey

[11] Patent Number: 4,691,480

[45] Date of Patent: Sep. 8, 1987

[54] VALVE SEAT GRINDING APPARATUS

[76] Inventor: John R. Kelsey, 424 Wessex Rd., Valparaiso, Ind. 46386

[21] Appl. No.: 819,281

[22] Filed: Jan. 16, 1986

Related U.S. Application Data

[63] Continuation-in-part of Ser. No. 650,841, Sep. 17, 1984, Pat. No. 4,610,112.

[51] Int. Cl.[4] ..... B24B 15/02

[52] U.S. Cl. ..... 51/241 A

[58] Field of Search ..... 51/241 A, 241 VS, 241 B, 51/241 S, 241 R, 119, 120

[56] References Cited

U.S. PATENT DOCUMENTS

| | | | |
|---|---|---|---|
| 757,053 | 4/1904 | Rameau . | |
| 771,194 | 9/1904 | Williams . | |
| 772,431 | 10/1904 | Rameau . | |
| 1,138,683 | 5/1915 | Murray . | |
| 1,142,570 | 6/1915 | Hodny . | |
| 1,412,867 | 4/1922 | Hill . | |
| 2,572,485 | 10/1951 | Hunter et al. . | |
| 2,649,669 | 8/1953 | Tobis . | |
| 2,674,069 | 4/1954 | Bauer . | |
| 2,720,736 | 10/1955 | McAfee . | |
| 2,794,303 | 6/1957 | Wickes . | |
| 2,865,142 | 12/1958 | Dunipace . | |
| 3,393,474 | 7/1968 | Buswell . | |
| 3,648,416 | 3/1972 | Rogers | 51/241 VS |
| 4,000,584 | 1/1977 | Uvetake et al. | 51/241 VS |
| 4,007,561 | 2/1977 | Okano et al. | 51/241 VS |
| 4,050,836 | 9/1977 | Anders | 51/241 A |
| 4,114,323 | 9/1978 | Okano et al. | 51/241 VS |
| 4,287,688 | 9/1981 | Jensen | 51/241 VS |

FOREIGN PATENT DOCUMENTS 2400077 7/1975 Fed. Rep. of Germany .

OTHER PUBLICATIONS

Brochure (pp. 0–13), *Machinebau GmbH & Co. KG,* Postfach 285, D5260 Duren, West Germany.

One page from phamplet *Maschinenfabrik A. Hauerwas GmbH & Co. KG,* Postfach 285, D5260 Duren, West Germany.

One page from phamplet, *EFCO Machinenbau GmbH & Co. KG,* Postfach 527, D–5160 Duren, West Germany.

One page of 2 photographs, Unislip GmbH, Postfach 7220, D–5180 Eschweiler, West Germany.

German Utility Model, 8,303,975, EFCO–Maschinenbau GmbH & Co. KG.

*Primary Examiner*—Roscoe V. Parker

[57] ABSTRACT

Valve seat grinding apparatus having a rotatable drive wheel of disk shape, a plurality of independently rotatable satellite wheels carried about the drive wheel with the respective radial planes of satellite wheels being disposed at a selected included angle with respect to the axis of drive wheel and disposed at a selected radial distance away from the axis of drive wheel. A plurality of slide blocks intermediately connect the drive wheel with satellite wheels. The selected included angle is selected in a range including 90 degrees. The drive wheel is provided of a shape, material and thickness to resist any deflection which would change selected included angle by forces within the range of operational forces applied through the drive wheel to satellite wheels.

10 Claims, 4 Drawing Figures

VALVE SEAT GRINDING APPARATUS

This application is a continuation-in-part of application Ser. No. 650,841, filed Sept. 17, 1984, and now U.S. Pat. No. 4,610,112.

FIELD OF THE INVENTION

The present invention generally relates to the grinding of valve seats while such seats remain installed in a valve body.

BACKGROUND OF THE INVENTION

Valve seat grinding apparatus has been described in U.S. Pat. No. 4,287,688. This patent, which shows a plurality of rotatable satellite grinding wheels attached to a central drive wheel, is specifically incorporated herein by reference.

A problem resulting from reworked valve seats is the reduction of valve sealing ability due to widening of the valve seat surface when the seat is resurfaced. Once the valve seat surface exceeds approximately 55% of the available seating surface of the disk or gate which seats against it, the valve is considered to need replacement. Standard operating procedure for narrowing the width of reconditioned valve seats is to grind a outer angular chamfer around the seat to reduce the annular width with a plate having an annular chamfer cut into the plate. This technique is used only by those highly skilled within the valve reconditioning industry and requires a particular plate for each particular sized valve seat. Such procedure can necessitate the utilization of as many as fifteen plates for different seats within a one valve size diameter.

OBJECTS OF THE INVENTION

One object of the present invention is to provide a drive wheel/satellite wheel grinding assembly which will permit no appreciable deflection of the angle at which the satellite wheels are mounted with respect to the drive wheel when the drive wheel is subjected to forces within the range of permissible operation of the assembly.

Another object of the present invention is to provide improved structure which facilitates setting the effective radius of the grinding satellite grinding wheels and also setting the effective included angle between the radial plane of the grinding wheels and the axis of the drive wheel.

SUMMARY OF THE INVENTION

The above and other objects are attained by valve seat grinding apparatus having a rotatable drive wheel of disk shape having central means for connection to be driven by rotary drive means and a plurality of independently rotatable satellite wheels carried about the drive wheel. The respective radial planes cf the satellite wheels are disposed at a selected included angle with respect to the axis of the drive wheel and disposed at a selected radial distance away from the axis of said drive wheel. A plurality of slide blocks intermediately connect the drive wheel respectively with the satellite wheels. The selected included angle may be selected in a range including 90 degrees. The drive wheel is provided of shape, of material and of thickness to resist any deflection which would change the selected included angle by forces within the range of the operational forces applied through the drive wheel to the satellite wheels. A plurality of radially extending, generally rectangular mounting grooves are defined in the front face and around the outer periphery of the drive wheel. A plurality of radially extending adjustment slots are disposed respectively in each of the grooves and extend from the front through to the rear of the drive wheel. A plurality of radially extending adjustment grooves are respectively disposed opposite to the mounting grooves on the rear surface of the drive wheel and extend around the adjustment slots. Each slide block is adapted to closely fit within each of the mounting grooves with each slide block being formed effectively square across its inner end and being beveled at its outer end. Each slide block also has a round hole extending from its front surface to its rear surface at an angle such that the radial plane of the round hole and the axis of the drive wheel are disposed at the selected angle. The round hole has a front counterbore and a rear counterbore. The slide block further defines a T-nut recess on its rear surface at its square inner end with a vertically extending slide block screw hole extending through the T-nut recess into the slide block. A T-nut is disposed in each T-nut recess, each T-nut including a square base portion with a vertically upwardly extending nose, each T-nut further having an aperture extending therethrough into which an adjustable connection screw is inserted through the adjustment slot to connect the slide block within the adjustment groove. The side blocks are adjustable to a respective radial distance from the center of said drive wheel through the provision of the radially extending slots disposed within the mounting grooves. Each satellite wheel is unitary including a generally flat grinding head and surface and a generally cylindrical body portion with an aperture extending into the front end and the rear end of the satellite wheel. Each satellite wheel is mounted within the round hole of a slide block and is supported by a front thrust rolling bearing disposed in the front counterbore and a lateral rolling bearing disposed between the cylindrical body portion and the inner wall of the round hole. A rear retainer member is mounted in the rear counterbore to retain the satellite wheel. The satellite wheel is freely rotatable within the front counterbore, the round hole and the rear counterbore. A coupler ball assembly is secured within the centrally located aperture of the drive wheel by a coupler support arrangement. The coupler ball is included with an arrangement through which a rotational movement and an operating force is imparted to the drive wheel and thereby to the satellite wheels. The slide block is utilized to adjust said satellite wheels at the selected angle which is selected to match the angle of relief of a particular valve seat.

DESCRIPTION OF A PREFERRED EMBODIMENT

Figure 4:
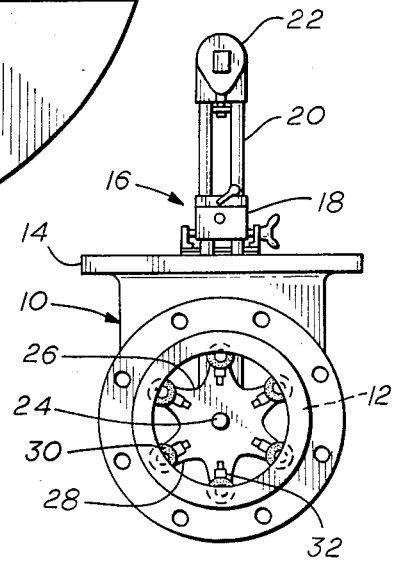
FIG. 4 (PRIOR ART)
FIG. 4 typically illustrates a prior art valve grinding apparatus which has facilities of adjusting the radius of the satellite grinding wheels as does the present invention.

Referring first to the Prior Art, FIG. 4, there is shown a valve body 10 with valve seat ring 12 installed. The apparatus comprises a support fixture 16 mounted to the valve flange 14. A clamp 18 fixes a pair of tubes 20 which connects drive member 22 at the top of the assembly with a drive member 26 adjacent to valve seat through a coupler ball arrangement 24 (not shown in detail). The drive member 26 has support fingers 28 which carry a plurality of satellite wheels 30. The wheels 30 are adjustable along slots 32 which are formed in the fingers 28.

This FIG. 4 resembles the structure shown in German Pat. No. GM 8303975 (1983), and the structure shown in U.S. Pat. No. 4,549,373, which issued from U.S. Ser. No. 705,869, filed Feb. 28, 1985 for "Apparatus for Grinding and Lapping Annular Sealing Faces". Reference is noted herein that disclosures of similar structure are of record in parent application, Ser. No. 650,841, referenced above.

Figure 1:
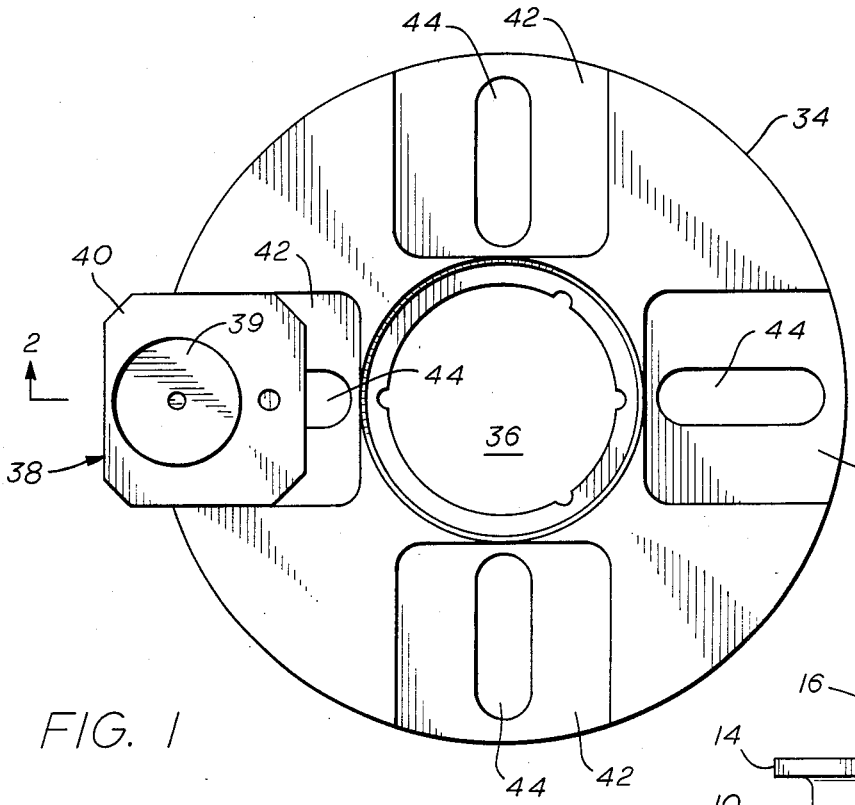
FIG. 1 is an elevational view of the front surface of the drive wheel of the present invention showing one slide block and satellite wheel of assembly installed typically.
Figure 2:
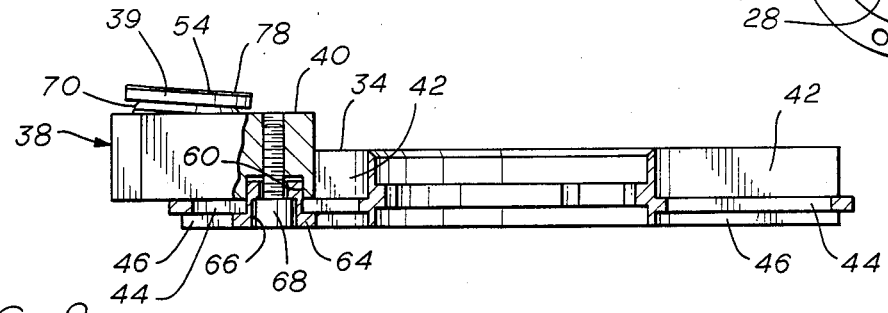
FIG. 2 is a partial sectional view of the drive wheel of FIG. 1 taken at line 2—2 including a partial sectional view of the satellite wheel assembly.

Referring now to FIGS. 1 and 2, the invention is seen to include a drive wheel 34 of disk shape having a central opening 36 which is formed for connection to a ball type coupler driving arrangement as outlined for the structure 24 shown in FIG. 4. The drive wheel 34 is adapted to carry a plurality of independently rotatable satellite wheel assemblies 38, one of which is shown installed in FIGS. 1 and 2. The drive wheel 34, as shown in FIGS. 1 and 2, is adapted to carry four of such satellite drive wheel assemblies 38 but the number of wheels carried may vary from a minimum of three to a maximum of several depending upon the diameter of the valve seat to be ground and corresponding diameter of drive wheel 34.

In the example shown, the drive wheel 34 will carry four slide blocks 40 which intermediately connect the satellite wheels 38 to the drive wheel 34.

Figure 3:
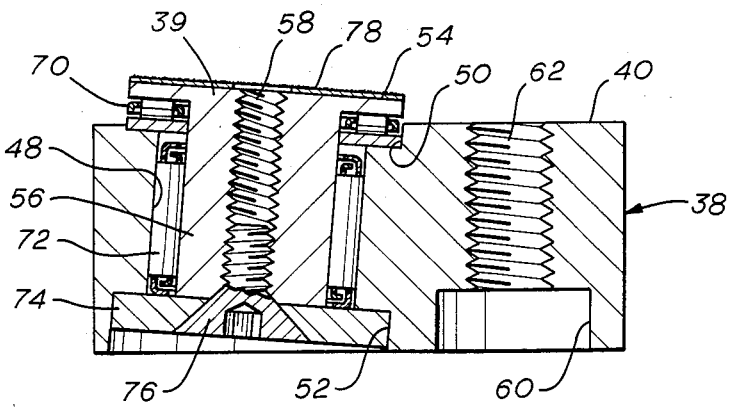
FIG. 3 is a cross-sectional view of the slide block and satellite wheel assembly as taken at Line 2—2 at FIG. 1.

As best shown in FIGS. 2 and 3, the satellite wheels 38 are carried at a selected angle with respect to the drive wheel 34 such that the selected angle between the radial plane of the satellite wheels 38 and the rotational axis of the drive wheel 34 has an included angle varying from ninety degrees (90° ) down to a particular chamfered beveled angle as found on a designated valve seat.

The purpose of grinding the chamfered bevel angle on a particular valve seat is to effectively reduce the effective width and area of the sealing surface of the valve seat which comes into direct contact with the complementary gate surface of a valve.

To accommodate mounting of the slide blocks 40, the drive wheel 34 is provided with a plurality of radially extending, generally rectangular, mounting grooves 42 as shown in FIGS. 1 and 2. Both the grooves and the sliding blocks are formed substantially square in order to permit maximum area of contact of the sliding block 40 with the driving wheel 34 with corresponding rigidity as the radial end of the sliding block is extended outwardly from the drive wheel 34 for a particular adjustment.

A plurality of adjustment slots 44 are provided through the drive wheel 34 in mounting grooves 42 as shown. Also, a plurality of radially extending adjustment grooves 46 are formed in the rear side of the drive wheel 34 and around the slots 44 to permit assembly of the slide blocks and satellite wheels as shown in FIG. 2. The sliding blocks 40 closely fit into the mounting grooves 42 in radially movable relationship best shown in FIG. 2.

Each slide block 40, as best shown in FIGS. 2 and 3, is formed generally rectangular in shape and has a round hole 48 extending from its front surface to its rear surface with a front counterbore 50 and a rear counterbore 52. The axis of the round hole 38 is disposed such that the radial plane of the round hole 48 is disposed at the selected angle with respect to the axis of drive wheel 34 which is the angle desired for the grinding face 54 of the satellite wheel 38.

As shown, each satellite wheel 38 is unitary including a generally flat grinding head 54 and a generally cylindrical body portion 56. An aperture is provided from the front and from the rear of the satellite wheel 38 which is common as shown to form a single threaded hole 58 through the satellite wheel 38.

Toward its inner end, slide block 40 has a bored T-nut recess 60 and a screw hole 62 extending further into the slide block and threaded. When assembled as shown in FIG. 2, a T-nut 64 having an aperture 66 is disposed in the T-nut recess 60 and fastened by means of a threaded connection screw 66 to fixedly retain the slide block 40 at a designated position within the mounting groove 42. Each T-nut 64 includes a square base portion with an upwardly extending nose where the square base portion provides a gripping relationship with the sliding block 40 between the adjustment groove 46 and the mounting groove 42.

Each satellite wheel 38 is mounted within the round hole 48 and supported against thrust movement by a rolling type thrust bearing 70 mounted between the grinding head 54 and the counterbore 50. The cylindrical body 56 is supported within the round hole 48 means of a lateral rolling bearing 72 as shown. Though the rolling bearings 70 and 72 are illustrated as generally cylindrical roller bearings, ball type rolling bearings may also be adapted for use. A rear retainer member 74 is rotatably fitted in the rear counterbore 52 and retained by a retainer screw member 76.

When assembled as shown in FIGS. 2 and 3, the satellite wheel 30 is free to rotate about its radial plane. An abrasive or grinding element 78 is affixed to the grinding face 54. When the drive member 34 carries the satellite wheel 38 around a circular valve seat (not shown) the satellite wheel 38 is rotated by the circular travel of the satellite wheel around the valve seat which causes the grinding element 78 to impart a grinding action between the grinding element 78 and the valve seat. Continued rotation of the satellite wheels 38 grinds a surface around the valve seat which is at the same angle with respect to the axis of the drive wheel 34 as the angle at which the satellite wheels have been set.

In operation, different sets of sliding blocks 40 are provided with each set being provided with holes 48 and counter bores 50 and 52 which will position the grinding face 54 and grinding elements 78 at the angle selected with respect to the axis of drive wheel 34 and the face of the valve seat to be reworked. When the angle is set at ninety degrees (90° ), then the grinding elements 78 are parallel with the sealing face of the valve to be reworked. When set at an angle less than ninety degrees (90° ), then the grinding face 54 and the grinding element 78 will grind a surface which is a chamfer of selected angle with respect to the sealing face of the valve seat.

Of course, the sliding blocks 40 may be radially adjusted by means of the adjustment slots 44 and fixing the sliding block with the T-nut at a particular radius.

It will be become obvious to those skilled in the art that the embodiment herein disclosed is exemplary only, and that other changes and modifications can be made without departing from the purview of the claims attached hereto.

I claim:

1. Valve seat grinding apparatus comprising:

(a) a rotatable drive wheel of disk shape having central means for connection to be driven by rotary drive means;

(b) a plurality of independently rotatable satellite wheels carried about said drive wheel with the respective radial planes of said satellite wheels being disposed at a selected included angle with respect to the axis of said drive wheel and disposed at a selected radial distance away from said axis of said drive wheel;

(c) a plurality of slide blocks intermediately connecting said drive wheel respectively with said satellite wheels;

(d) said selected included angle being selected within a range including ninety degrees (90°); and (e) said drive wheel being made of shape, of material and of thickness to resist any deflection which would change said selected included angle by forces applied through said drive wheel to said satellite wheels within the operational range of forces employed with said apparatus;

2. The apparatus of claim 1 further comprising:

(a) a plurality of radially extending, generally rectangular mounting grooves defined in the front face and around the outer periphery of said drive wheel;

(b) a plurality of radially extending adjustment slots respectively disposed in each of said grooves and extending from the front through to the rear of said drive wheel; and (c) a plurality of radially extending adjustment grooves respectively disposed opposite to said mounting grooves on the rear surface of said drive wheel and extending around said adjustment slots.

3. The apparatus of claim 2 wherein:

(a) a slide block is adapted to fit within each of said mounting grooves with each said slide block being formed effectively square across its inner end and being beveled at its outer end;

(b) each slide block also having a round hole extending from its front surface to its rear surface at an angle such that the radial plane of said round hole and the axis of said drive wheel are disposed at said selected included angle; and (c) said round hole having a front counterbore and a rear counterbore.

4. The apparatus of claim 3 further comprising:

(a) said slide block further defining a T-nut recess on its rear surface at its square inner end with a vertically extending slide block screw hole extending through said T-nut recess into said slide block;

(b) a T-nut disposed in each T-nut recess and in said adjustment groove, each said T-nut including a square base portion with a vertically upwardly extending nose, each said T-nut further having an aperture extending therethrough into which an adjustable connection screw is inserted through said adjustment slot to connect said slide block within said adjustment groove and said sliding block within said mounting groove.

5. The apparatus of claim 3, wherein said slide blocks are respectively adjustable to a selected radial distance from the center of said drive wheel through the provision of said radially extending slots disposed within said mounting grooves.

6. The apparatus of claim 3 wherein each satellite wheel is unitary including a generally flat grinding head and a generally cylindrical body portion with an aperture extending into the the rear end of said satellite wheel.

7. The apparatus of claim 6 wherein each said satellite wheel is mounted within said round hole of a said slide block and supported by a front thrust rolling bearing disposed in said front counterbore, a lateral rolling bearing mounted in said round hole, a rear retainer member mounted in said rear counterbore, and a retainer screw, said satellite wheel being freely rotatable within said front counterbore, said round hole and said rear counterbore.

8. The apparatus of claim 1 wherein said central means comprises coupler ball means secured within a centrally located aperture of said drive wheel by coupler means.

9. The apparatus of claim 8 wherein said coupler ball means includes means through which rotational movement and an operating force is imparted to said drive wheel and thereby to said satellite wheels.

10. The apparatus of claim 3 wherein said slide block is utilized to adjust said satellite wheels at said selected angle which is selected such as to match the angle of relief of a particular valve seat.

* * * * *